US006042511A

United States Patent [19]

Bulloch

[11] Patent Number: 6,042,511

[45] Date of Patent: Mar. 28, 2000

[54] HOCKEY TRAINING APPARATUS

[76] Inventor: Ron C. Bulloch, 6134 Eagle Creek Dr., Fort Wayne, Ind. 46804

[21] Appl. No.: 09/111,014

[22] Filed: Jul. 7, 1998

[51] Int. Cl.[7] ..... A63B 23/04; A63B 22/08

[52] U.S. Cl. ..... 482/51; 482/79; 482/71

[58] Field of Search ..... 482/51, 70, 71, 482/79, 80

[56] References Cited

U.S. PATENT DOCUMENTS

| | | |
|---|---|---|
| 3,627,315 | 12/1971 | Marcyan . |
| 3,756,595 | 9/1973 | Hague . |
| 3,834,693 | 9/1974 | Poppenberger . |
| 4,601,464 | 7/1986 | Mousel . |
| 4,781,372 | 11/1988 | McCormack . |
| 4,811,941 | 3/1989 | Elo . |
| 4,915,373 | 4/1990 | Walker . |
| 4,993,704 | 2/1991 | Luczynski . |
| 5,044,355 | 9/1991 | Reopelle . |
| 5,279,531 | 1/1994 | Jen-Huey . |
| 5,284,460 | 2/1994 | Miller et al. . |
| 5,316,530 | 5/1994 | Römer . |
| 5,496,239 | 3/1996 | Kallman et al. . |
| 5,503,609 | 4/1996 | Bull . |
| 5,520,598 | 5/1996 | Little . |

*Primary Examiner*—S. Ro Crow
*Attorney, Agent, or Firm*—Barnes & Thornburg

[57] ABSTRACT

An exercise, training and conditioning apparatus for skaters which includes a pair of movable foot platforms that are guided along a pair of coupled track sections, and a latching mechanism that alternatively secures and releases one of the pair of foot platforms while releasing and securing another one of the pair of foot platforms. According to one embodiment, the pair of track sections are coupled together at 90°. Resistance to movement is applied to the pair of foot platforms by elastic or inelastic cables.

20 Claims, 5 Drawing Sheets

HOCKEY TRAINING APPARATUS

TECHNICAL FIELD

The present invention relates to exercise and training devices for ice skaters. More particularly, the present invention is directed to devices for exercising, strengthening and conditioning the muscles of ice skaters and for training hockey players in proper stride techniques.

BACKGROUND ART

It has long been recognized that training and exercise activities which are specific to a sport that one wishes to excel in are beneficial and that such exercises can develop improved strength and agility in the actual groups of muscles used when participating in the particular sport. When one exercises for a specific sport, one not only gains strength and endurance, but one also increases his or her skills in performing that sport. Exercises embodying resistance to muscle movement increase the strength of the muscle groups being exercised. Moreover, it has been found that exercising muscles at the specific angle at which they are utilized in a particular sport significantly improves one's skill in that sport. Therefore, in order to increase their skill, strength and endurance in a particular sport, athletes will frequently engage in exercises that mobilize specific muscle groups.

The forward stride is a basic or fundamental maneuver in hockey which involves particular skate and body positions and movement of a skater's legs. While performing the forward stride, a skater starts with his feet in a "V" or "Arrow Tip" position and, after each stride, returns his feet to this position. At the same time, the skater bends his knees over the front of his skates, and maintains his back straight and shoulders square.

The best way to master the forward stride and to train and condition one's muscles to efficiently perform this basic maneuver is to practice this maneuver on ice. This requires a considerable amount of practice time on ice or "ice time" which may not be available, particularly in locations where there are limited ice facilities that are heavily scheduled.

Several ice skating exercising devices have been proposed which allow skaters to exercise off ice, including those disclosed in U.S. Pat. No. 5,503,609 to Bull, U.S. Pat. No. 5,284,460 to Miller et al., U.S. Pat. No. 4,915,373 to Walker, U.S. Pat. No. 4,811,941 to Elo, U.S. Pat. No. 4,781,372 to McCormack, U.S. Pat. No. 4,340,214 to Schützer and U.S. Pat. No. 3,756,595 to Hague. Other related exercise devices can be found in U.S. Pat. No. 5,520,598 to Little, U.S. Pat. No. 5,496,239 to Kallman et al., U.S. Pat. No. 5,316,530 to Römer, U.S. Pat. No. 5,279,531 to Jen-Huey, U.S. Pat. No. 5,044,355 to Reopelle, U.S. Pat. No. 4,993,704 to Luczynski, U.S. Pat. No. 4,601,464 to Mousel, U.S. Pat. No. 3,834,693 to Poppenberger, and U.S. Pat. No. 3,627,315 to Marcyan.

The present invention is directed to a device for exercising, strengthening and conditioning the muscles of ice skaters and for training hockey players in proper form and stride techniques.

DISCLOSURE OF THE INVENTION

The present invention provides an exercise apparatus which can be used by a skater to practice basic stride techniques, develop proper form, and condition muscles.

The present invention further provides an exercise apparatus which simulates actual "on ice" conditions associated with basic stride techniques.

The apparatus of the present invention includes a pair of track sections which can be coupled together during use, a pair of platforms, and a latching mechanism. Each one of the pair of platforms is coupled to one of the pair of track sections for movement thereon. The latching mechanism includes structure for alternatively securing and releasing one of the pair of platforms while releasing and securing another one of the pair of platforms.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to devices for exercising, strengthening and conditioning the muscles of ice skaters and for training hockey players in proper form and stride techniques. The devices of the present invention allow a skater to practice the forward stride in a manner which simulates actual conditions on ice. In this regard, the devices of the present invention allow a skater to keep his feet in the "V" or "Arrow Tip" position after each stride. Moreover, the devices allow a skater's feet to move outward and rearward at an angle which will develop the optimum thrust. By bending his knees over the front of his skates and maintaining his back straight and shoulders square while using the devices of the present invention, a skater can develop proper form while conditioning his muscles.

The devices of the present invention include a pair of platforms which the user stands on so that one foot is on each of the platforms. The platforms are coupled to a rail or track assembly which guides movement of the platforms. The rail or track assembly includes two rail or track sections which are coupled together at an angle. The angle at which the rail or track sections intersect is preferably 90°. However, this angle can be varied, and according to one embodiment of the present invention, the angle at which the rail or track sections intersect is adjustable.

The devices of the present invention include a latching mechanism which alternatively locks one of the platforms in a stationary position, while the other platform is allowed to slide along its respective rail or track section. As the unlocked or unlatched platform engages the latching mechanism, that platform becomes latched or locked in a stationary position and the other platform is released by the latching mechanism whereby it is allowed to move along its respective rail or track section. Thus, as described in more detail below, the latching mechanism allows the user to stride alternatively with each foot/leg. This movement simulates the forward stride as it is actually preformed on ice.

The devices of the present invention include means for applying and adjusting resistance against the sliding movement of the platforms along their respective rail or track sections. By applying and adjusting, e.g. increasing, resistance against the sliding movement of the platforms, one can strengthen muscles that are used in performing the forward stride. Various means to apply and adjust resistance against the sliding movement of the platforms include elastic cables, flexible bows, weights and cable systems, fluid pistons, elastic bands, etc.

Figure 1:
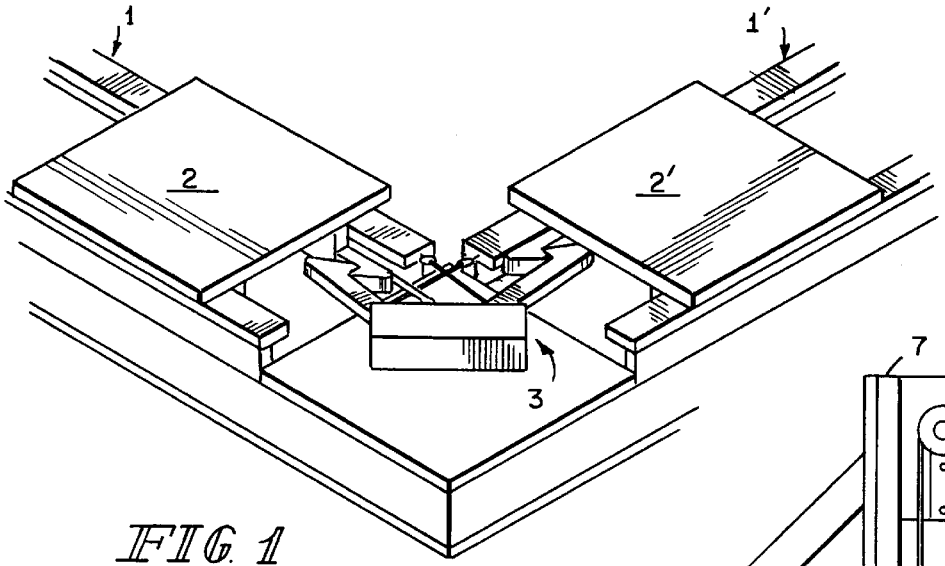
FIG. 1 is a perspective view of an exercise/training device according to one embodiment of the present invention.

FIG. 1 is a perspective view of an exercise/training device according to one embodiment of the present invention. The device includes two rail or track sections 1, 1' which are coupled together at adjacent ends so that the rail or track sections 1, 1' intersect at an angle as shown. The angle at which the track or rail sections 1, 1' intersect is preferably about 90°. However greater (up to 180°) or smaller (down to 0°) angles can be used if desired. According to one embodiment in which the rail or track sections 1, 1' are coupled by a pivotal connection, the angle at which they intersect can be easily adjusted.

Each rail or track section 1, 1' includes a platform 2, 2'. The platforms 2, 2' are designed to freely slide along their respective rail or track sections 1, 1'. The platforms 2, 2' provide a movable stage upon which a user stands so that each of the user's feet are on one of the platforms 2, 2'. Thus, it is understood that the size of the platforms 2, 2' is such to receive a person's foot. The upper surfaces of the platforms 2, 2' can be provided with a medium, e.g. rubber mat, that has a roughened surface which increases the frictional forces between a user's feet and the platform surfaces. Otherwise, the upper surface of the platforms 2, 2' can themselves be roughened to increase the frictional forces between a user's feet and the platform surfaces. In addition, the rear edges of the platforms 2, 2' can be provided with small upright structures, against which a user's feet can abut.

The platforms 2, 2' are coupled to the rail or track sections 1, 1' by wheels or bearings which allow the platforms 2, 2' to move freely along the rail or track sections 1, 1'. The rail or track sections 1, 1' guide the movement of the platforms 2, 2' and the feet of the user, thus assuring that the user performs a desired stride motion while exercising/training.

A latching mechanism 3 is provided adjacent the point at which the rail or track sections 1, 1' intersect. The latching mechanism 3 alternatively latches or locks one of the platforms 2, 2' in a stationary position, while allowing the other platform 2, 2' to move along its respective rail or track section 1, 1'. Details of the latching mechanism 3 will be discussed more fully below.

Resistance forces can be applied to the platforms 2, 2' by attaching elastic or inelastic cables thereto, which cables can extend beneath the platforms 2, 2' and within the rail or track sections 1, 1'. Such resistance applying and adjusting means are mentioned above and discussed in more detail below.

Figure 2:
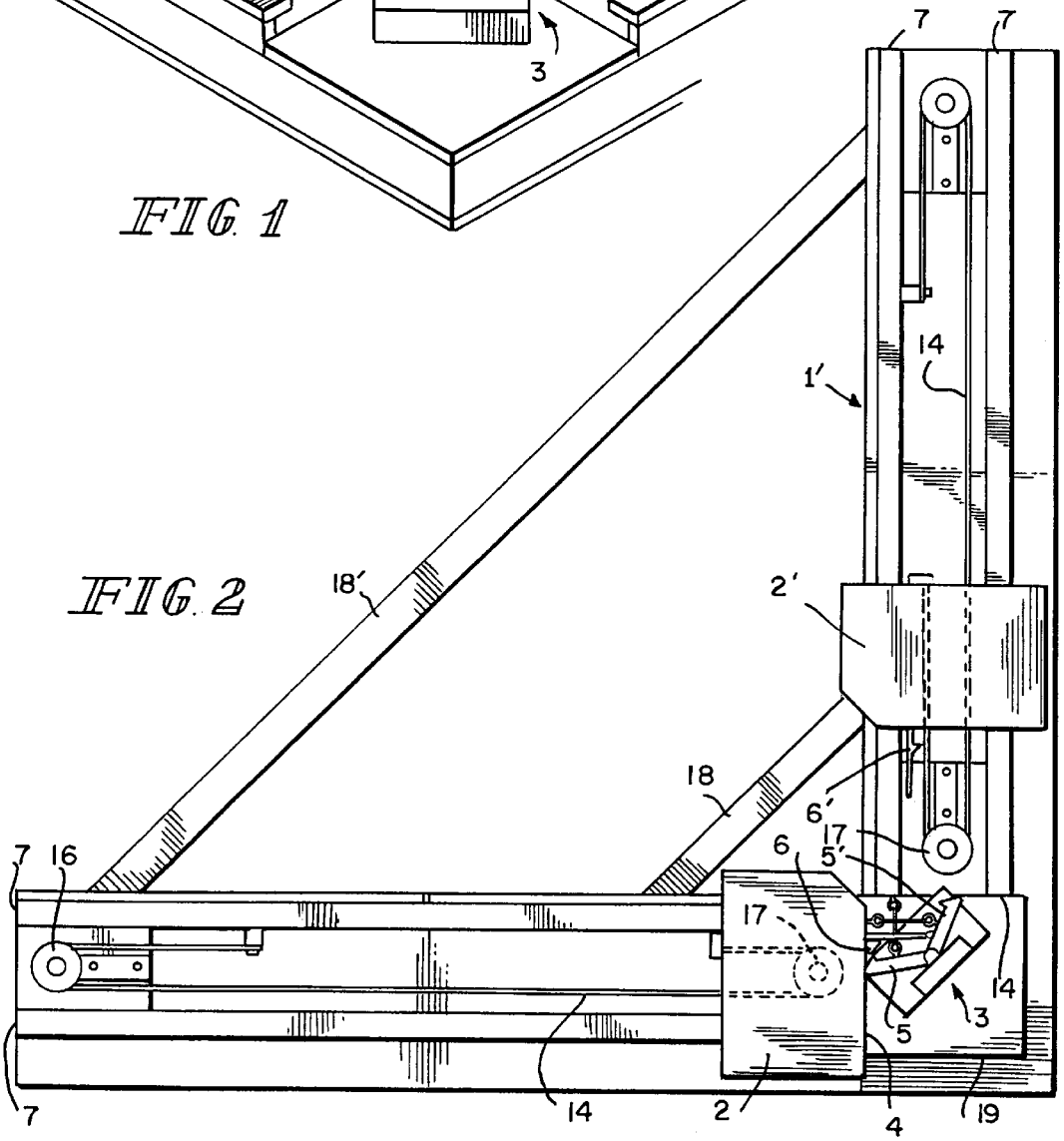
FIG. 2 is top view of the exercise/training device of FIG. 1.

FIG. 2 is top view of the exercise/training device of FIG. 1. The rail or track sections 1, 1' are depicted as being coupled together at adjacent ends 4, 4', between which latching mechanism 3 is located. The latching mechanism 3 includes opposed pivotal latching arms 5, 5' which are spring biased to engage fixed latching arms 6, 6' that are mounted on the platforms 2, 2'. Also, shown in FIG. 2 are disengaging projections associated with the latching mechanism 3 which cause the pivotal latching arms 5, 5' to pivot and become disengaged or unlatched from the fixed latching arms 6, 6' of the platforms 2, 2'. As discussed below, the disengaging projections can be attached and extend from the platforms 2, 2' or can be attached and extend from the pivotal latching arms 5, 5', so that as the disengaging projections strike the pivotal latching arms 5, 5' or are struck by the platforms 2, 2', the pivotal latching arms 5, 5' pivot to a release position. Although depicted as being straight, the pivotal latching arms 5, 5' can be angled (or curved) as necessary to accommodate various angles at which the rail or track sections 1, 1' intersect.

FIG. 2 depicts the upper edge portions 7 of the rail or track sections 1, 1'. These upper edge portions 7 are provided to retain the platform wheel assembly 8 (see FIG. 3) of the platforms 2, 2'. This platform wheel assembly 8 allows the platforms 2, 2' to move easily along the rail or track sections 1, 1'.

In the embodiment of the invention depicted in FIG. 2 an elastic cable 14 is attached to each of the platforms 2, 2' to provide resistance. As depicted in track or rail section 1, one end of the elastic cable 14 is attached to a fixed location in the track or rail section 1, and the other end of the elastic cable 14 is attached to platform 2. The elastic cable 14 passes through pulleys 16 and 17 at opposite ends of the track or rail sections 1, 1' so as to apply a forward biasing force to the platforms 2, 2'. According to one embodiment, bungee cord was used as the elastic cable 14.

One or more brace members 18 can be provided between the rear portions of the rail or track sections 1, 1'. According to one embodiment of the present invention, the fixed end of the elastic cables 14 can be secured in adjustable positions in or along one of the brace members 18. In this regard, pulley 16 can be positioned to allow elastic cables 14 to extend along or within one of the brace members 18. The free end of the elastic cables 14 can be fixed in adjustable positions along the brace member 18 by means of pins, hooks, etc.

The rail or track sections 1, 1' can be coupled together by means of a rectangular or triangular platform 19 which supports the latching mechanism 3. According to another embodiment of the present invention, the adjacent ends 4, 4' of the rail or track sections 1, 1' are partially capped with end pieces that can be pivotally coupled together.

Figure 3:
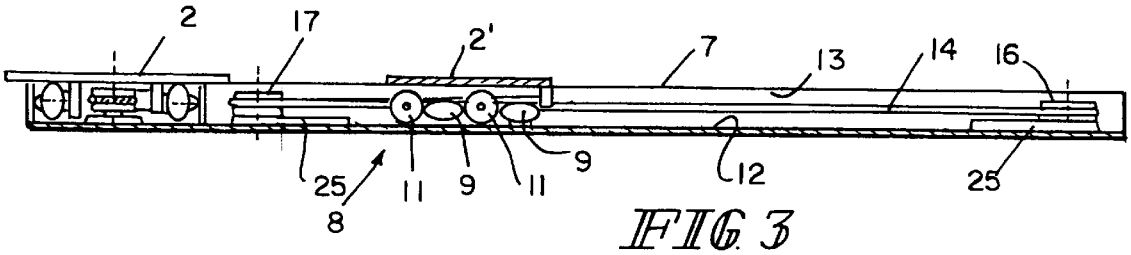
FIG. 3 is a sectional view of one side of the exercise/training device of FIG. 1.

FIG. 3 is a sectional view of one side of the exercise/training device of FIG. 1. FIG. 3 depicts how the platform wheel assembly 8 maintains the vertical position of the platforms 2, 2'. That is, as shown, the vertical wheels 11 are positioned between the bottom 12 of the rail or track sections 1, 11 and the lower surface 13 of the upper edge portions 7 of the rail or track sections 1, 1'. The horizontal wheels 9 engage the inner side surfaces 10 of the rail or track sections 1, 1' and thus maintain the axial position of the platforms 2, 2' with respect to the central axes of the rail or track sections 1, 1'.

FIG. 3 also depicts how elastic cable 14 extends through pulleys 16 and 17 and is attached at opposite ends to platform 1 and a fixed position 20. Pulleys 16 and 17 can either be attached to ends of the rail or track sections 1, 1' or to bottom portions of the rail or track sections 1, 1' adjacent the ends thereof.

Figure 4:
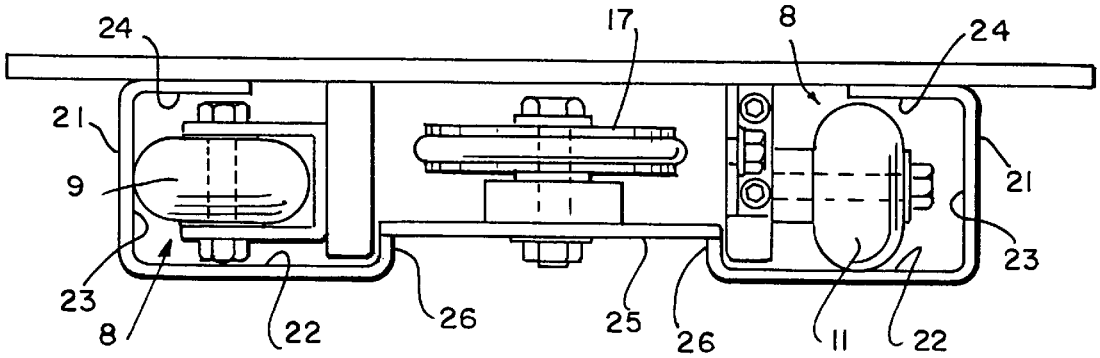
FIG. 4 is a cross sectional view of another embodiment of the rail or track sections of the present invention.

FIG. 4 is a cross sectional view of another embodiment of the rail or track sections 1, 1'. Whereas the rail or track sections depicted in FIGS. 1–3 can be made out of metal, wood, composite materials, or any suitably rigid materials, the rail or track section 1 of FIG. 4 is a formed metal structure. In this embodiment, each rail or track section 1, 1' includes opposed elongate channel members 21 that are configured to receive therein the platform wheel assembly 8. As depicted, the elongate channel members 21 are configured to include U-shaped bottom portions 22, side walls 23 and upper edge portions 24. The horizontal wheels 9 of the platform wheel assembly 8 are shown as engaging the inner side walls 23 of the elongated channel members 21. Similarly, the vertical wheels 11 of the platform wheel assembly 8 engage the bottom portion 22 of the elongate channel members 21 and the lower surface 13 of the upper edge portions 7 of the elongate channel members 21.

The opposed elongate channel members 21 of each track or rail section 1, 1' can be coupled together by one or more plate members 25 that are attached between each elongate channel member 21. The pulleys 16, 17 which guide the elastic or inelastic cables that apply resistance to the platforms 2, 2' can be mounted on plate members 25 as depicted in FIG. 4. Because the facing surfaces 26 of the elongate channel members 21 are located at a height above the bottom portion thereof, the pulleys 16, 17 are positioned above the bottom portion 22 and there is adequate clearance beneath the plate members 25 for mechanical fasteners to secure the pulleys 16, 17 as depicted.

Figure 5:
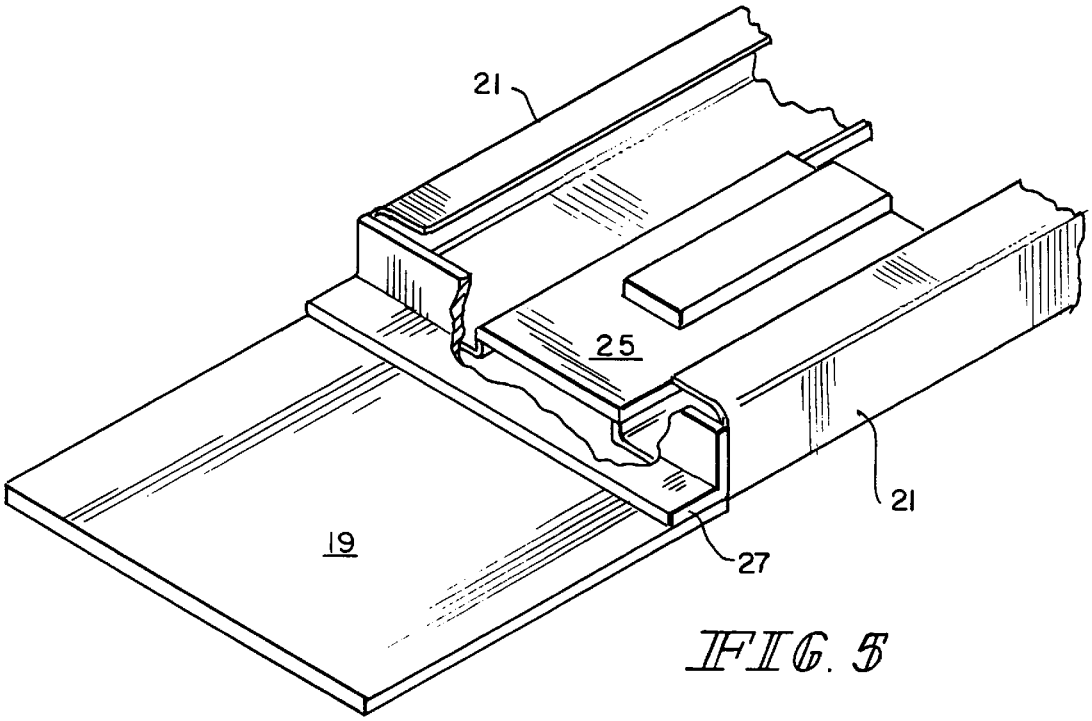
FIG. 5 is a sectional view of one side of the rail or track section of FIG. 4.

FIG. 5 is a sectional view of one side of the rail or track section of FIG. 4. FIG. 5 depicts one manner by which the rail or track sections 1, 1' can be coupled together. In this regard, an angled piece or plate 27 is attached to the leading ends 4,4' of the rail or track sections 1, 1' as depicted. The angled plate 27 can also be attached to the plate member 25 which is attached between the elongate channel members 21. The rail or track sections 1, 1' are coupled together by coupling their angled plates 27 together as shown in FIG. 6.

Figure 6:
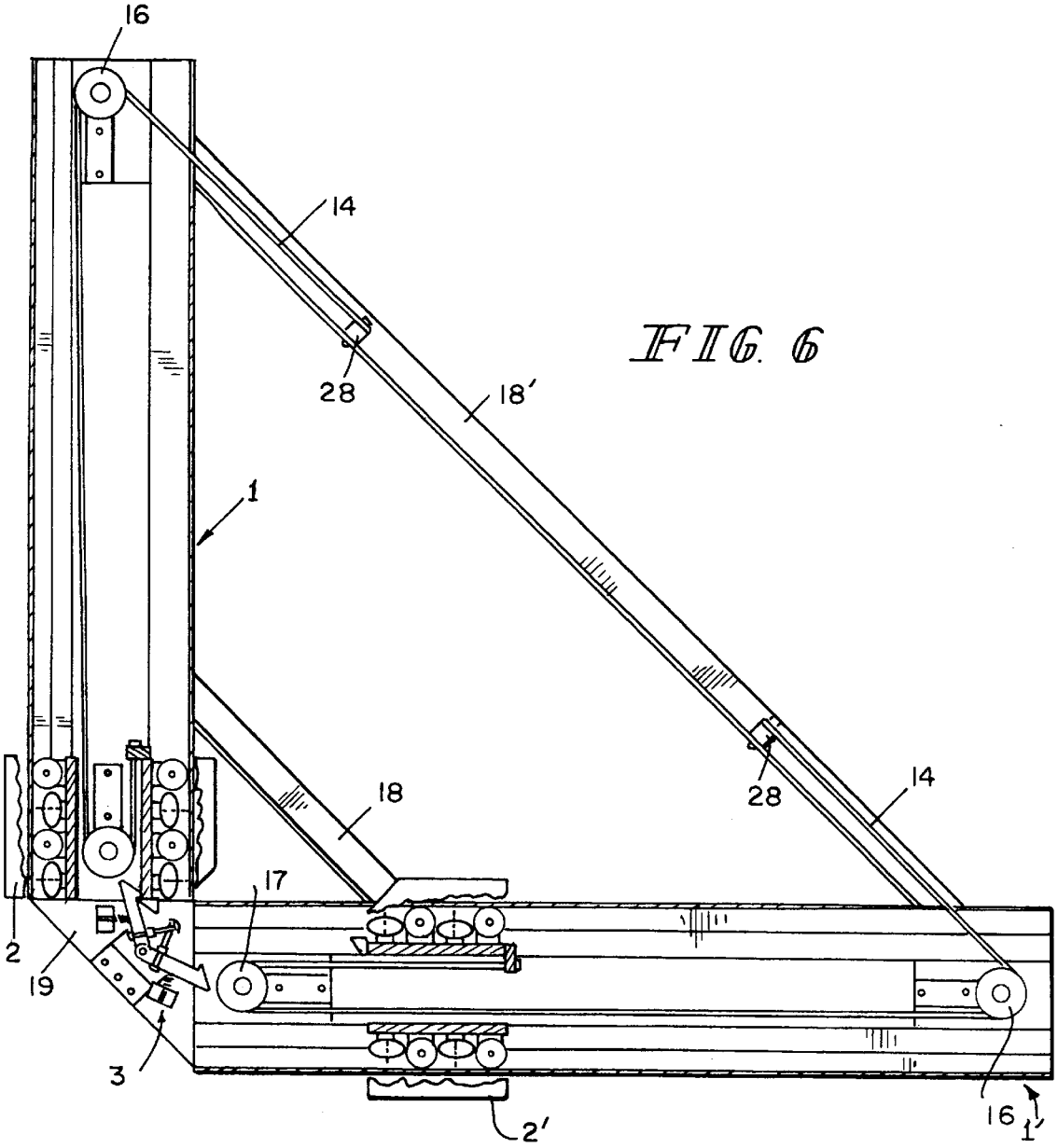
FIG. 6 is a top view of an exercise/training device which utilizes the rail or track sections of FIGS. 4 and 5.

FIG. 6 is a top view of an exercise/training device which utilizes the rail or track sections of FIGS. 4 and 5. The rail or track sections 1, 1' in FIG. 6 are coupled together by a triangular platform 19 which can be coupled to the angled plates 27 that are attached to the adjacent ends of the rail or track sections 1, 1'. For example, the triangular platform 19 could be coupled to the angled plate by pins, bolts, or other cooperating engaging structures or mechanical fasteners. The latching mechanism 3 is attached to and supported by triangular platform 19.

FIG. 6 depicts two brace members 18, 18' between the rail or track sections 1, 1' which help maintain the angular alignment of the rail or track sections 1, 1'. As depicted, the rear most brace member 18' receives one end of the elastic cable 14 of each of the rail or track sections 1, 1' (one shown). In this regard, brace member 18' preferably includes a channel through which the elastic cables 14 extend so as to protect the elastic cables 14. In addition, brace member 18' includes a plurality of spaced apart pins, hook, holes, etc. 28 which allow the free ends of elastic cables 14 to be attached at different positions along brace member 18' in order to adjust the resistance applied the platforms 2, 2'.

The angle at which the rail or track sections 1, 1' intersect in the embodiment of the invention depicted in FIG. 6 can be varied by merely varying the angle of the legs of triangular platform 19 and the length of brace members 18, 18'. According to a further embodiment, the angled plates 27 of the rail or track sections 1, 1' can be attached together by a pivotal connection which will allow the angle at which the rail or track sections 1, 1' intersect to be adjusted from 0° to 180°. In this embodiment, the rail or track sections 1, 1' can be folded together for purposes of storing or shipping the device. When assembled, the triangular platform 19 and brace members 18, 18 can be used to maintain the angle between the rail or track members 1, 1'.

Figure 7:
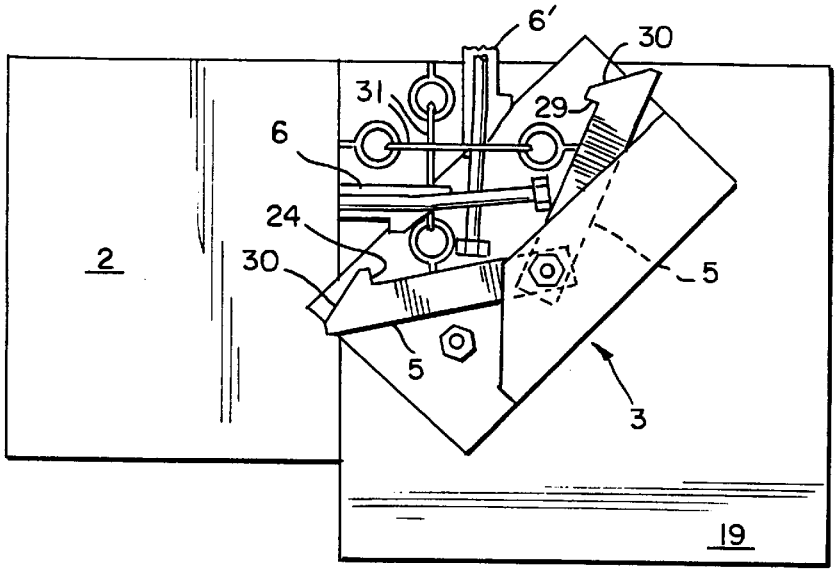
FIG. 7 is top view of the details of a latching mechanism according to one embodiment of the present invention.

FIG. 7 is top view of the details of a latching mechanism according to one embodiment of the present invention. The latching mechanism 3 includes two opposed pivotal latching arms 5, 5'. The pivotal latching arms 5, 5' are opposed in that they include hook projections 29 that extend inwardly toward one another. The pivotal latching arms 5, 5' also include angled cam surfaces 30 on their distal ends which cooperate with corresponding cam surfaces provided on the fixed latching arms as discussed in more detail below. The pivotal latching arms 5, 5' are biased inwardly by elastic members 31 which are attached between the pivotal latching arms 5, 5' and the leading edge of the rail or track sections 1, Each platform 2, 2' is provided with a fixed latching arm 6, 6' which is cooperatively aligned with a respective pivotal latching arm 5, 5'. As discussed above, in use, one platform is secured in a fixed position by the latching mechanism 3, while the other platform slides along its respective rail or track section. Accordingly, FIG. 7 shows how platform 2' would be engaged by pivotal latching arm 5. Platform 2 includes both a fixed latching arm 6 and disengaging projection 32. As platform 2 moves toward latching mechanism 3, the disengaging projection 32 contacts pivotal latching arm 5' and pushes pivotal latching arm 5' outward so as to disengage pivotal latching arm 5' and fixed latching arm 6' which extends from platform 2'. As platform 2' becomes disengaged from the latching mechanism 3, platform 2 becomes engaged by the latching mechanism 3. That is, as platform 2 moves toward latching mechanism 3, the fixed latching arm 6 on platform 2 contacts pivotal latching arm 5, causing the cooperating cam surfaces of thereof to push pivotal latching arm 5 outward and into engagement with fixed latching arm 6 as platform 2 continues to move forward. This unlatching/latching process which allows the platforms 2, 2' to alternatively be released and latched in their forward positions is repeated every time one of the platforms 2, 2' moves to its forward position.

Figure 8:
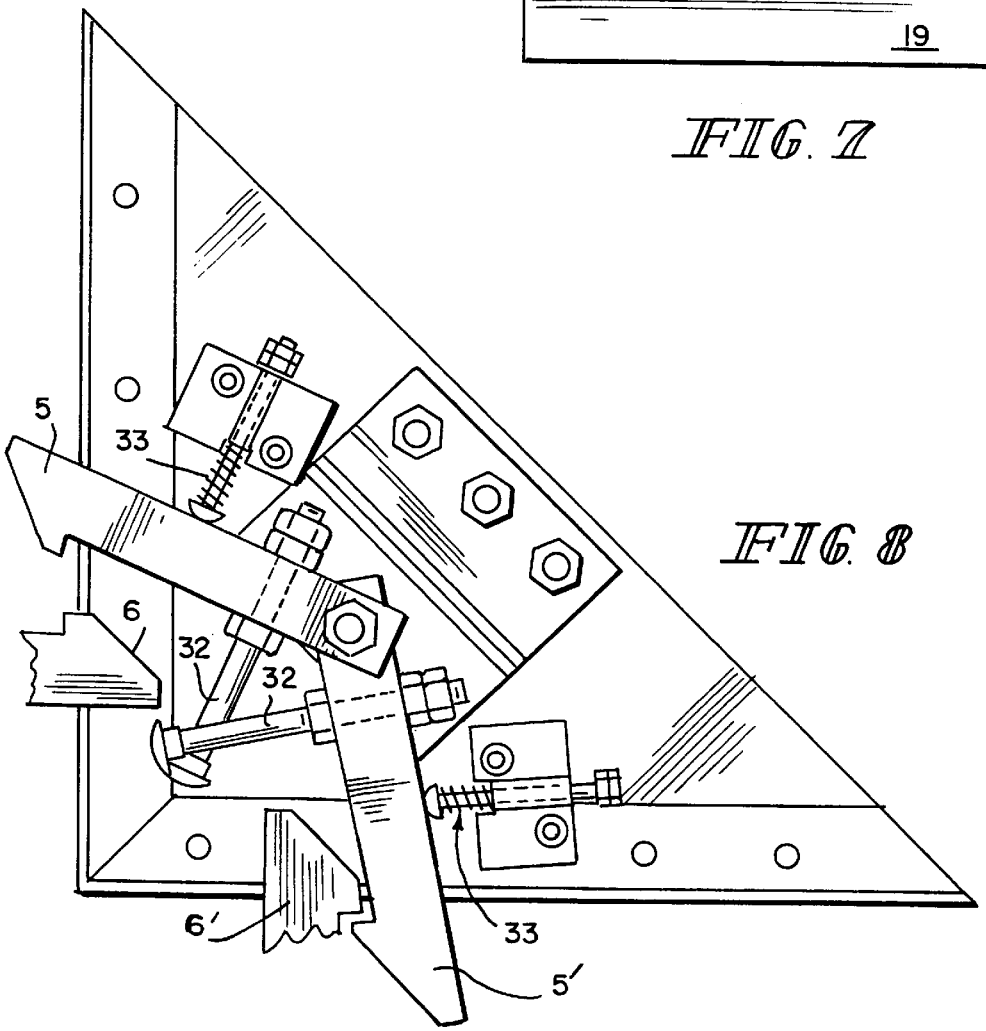
FIG. 8 is top view of the details of a latching mechanism according to another embodiment of the present invention.

FIG. 8 is top view of the details of a latching mechanism according to another embodiment of the present invention. In this embodiment, the pivotal latching arms 5, 5' are biased inwardly by spring elements 33. Also in this embodiment, the disengaging projections 32 are provided so that they extend from the pivotal latching arms 5, 5'. By providing the disengaging projections 32 on the pivotal latching arms 5, 5', the fixed latching arms 6, 6' which are attached to the platforms 2, 2' can abut and strike the disengaging projections 32 while alternatively releasing the platforms, and engaging the pivotal latching arms 5, 5' in a latching manner. As depicted, the fixed latching arms 6, 6' can comprise fixed latching structures which include hook projections 34 and cam surfaces 35 without an "arm" structure. Also, the forward edge of the platforms 2, 2' can include an abutting structure which engages the disengaging projections 32 of the latching mechanism 3. The modifications of this embodiment provide a more compact latching mechanism 3 and allow the elements of latching mechanism 3 to be concealed.

Figure 9:
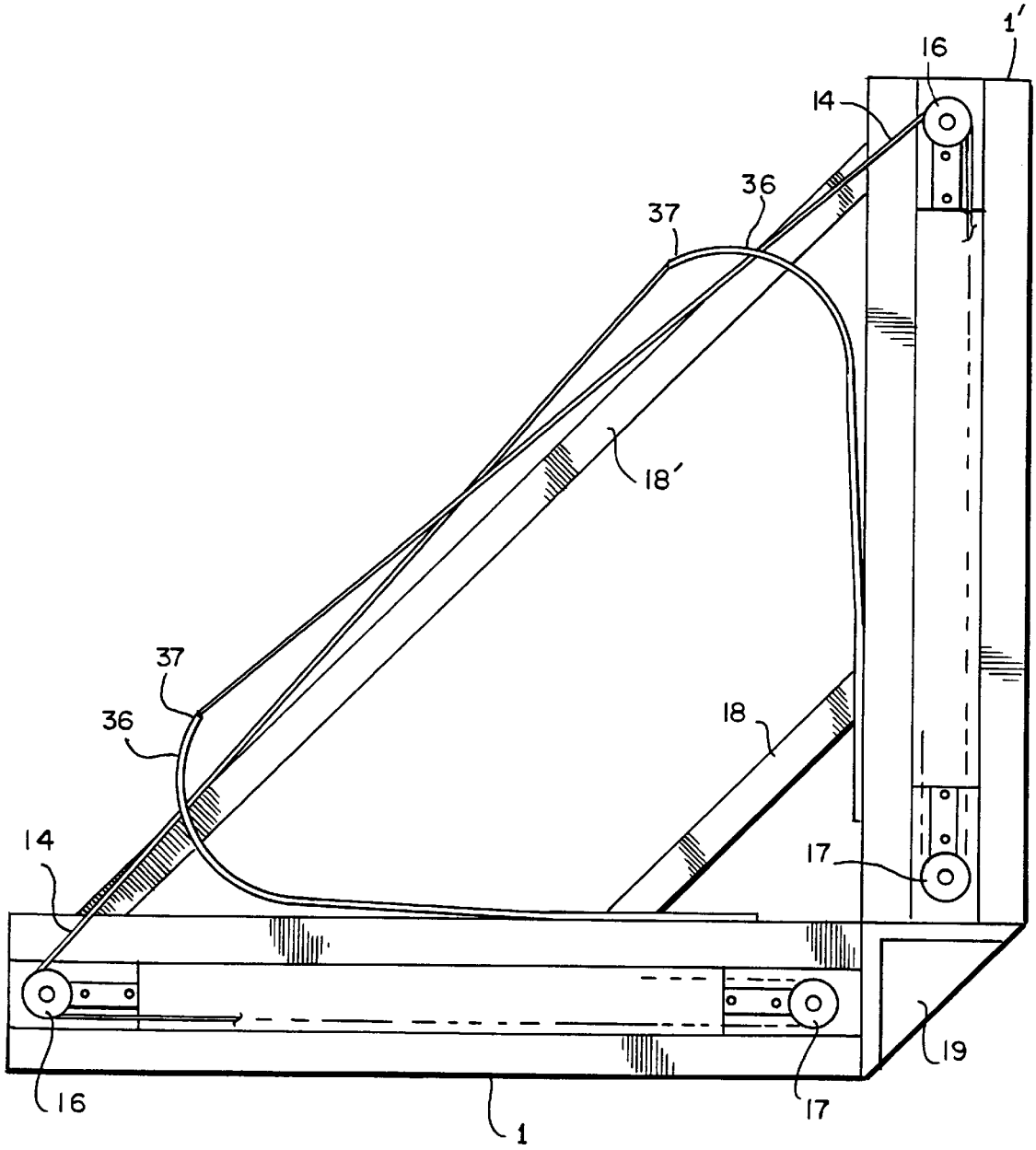
FIG. 9 is a top view of an alternative embodiment of the present invention in which the resistance is applied to the platforms by flexible bow elements.

FIG. 9 is a top view of an alternative embodiment of the present invention in which the resistance is applied to the platforms 2, 2' by flexible bows. As depicted, cables 14 pass through pulleys 16 which are located near the end of the rail or track sections 1, 1' and are attached to bow elements 36. The bow elements 36 are flexible elongate elements which are securely attached to the rail or track sections 1, 1' at one end and are provided with free ends 37 to which cables 14 can be attached. Because the bow elements 36 are flexible, their free ends 37 can be pulled away from the adjacent rail or track sections 1, 1'. The bow elements 36 are preferably stiff enough, so that they provide a desired degree of resistance to being flexed or pulled away from the adjacent rail or track sections 1, 1'. This resistance is applied to the platforms 2, 2' through inelastic cables 14. Weights that can be pulled upward by a system of cables and pulleys, fluid pistons, elastic bands, etc. can be used as alternatives to the use of flexible bow elements according to other embodiments of the present invention.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A training apparatus for skaters which comprises:

a pair of track sections;

a pair of platforms, each one of the pair of platforms being coupled to one of the pair of track sections for movement thereon; and a latching mechanism, said latching mechanism including structure for alternatively securing and releasing one of the pair of platforms while releasing and securing another one of the pair of platforms.

2. A training apparatus for skaters according to claim 1, wherein each one of the pair of track sections are linear and coupled together at adjacent ends.

3. A training apparatus for skaters according to claim 2, wherein the latching mechanism is positioned between the adjacent ends of the pair of track sections.

4. A training apparatus for skaters according to claim 1, wherein the operable latching structure includes at least one movable latching means.

5. A training apparatus for skaters according to claim 4, wherein the operable latching structure includes at least one pivotal latching means.

6. A training apparatus for skaters according to claim 5, wherein the operable latching structure includes two pivotal latching means.

7. A training apparatus for skaters according to claim 1, wherein each one of the pair of platforms includes a latch engaging structure which engages the latching mechanism.

8. A training apparatus for skaters according to claim 1, further comprising a resistance applying a cable coupled to each one of the pair of platforms.

9. A training apparatus for skaters according to claim 8, wherein the resistance applying cables are elastic.

10. A training apparatus for skaters according to claim 1, wherein each one of the pair of platforms includes a wheel assembly.

11. A training apparatus for skaters according to claim 10, wherein each wheel assembly includes wheels which lie in non-parallel planes.

12. A training apparatus for skaters according to claim 11, wherein each wheel assembly includes wheels which lie in orthogonal planes.

13. A training apparatus for skaters according to claim 6, wherein each of said two pivotal latching means are provided with a projection which projections are aligned to be struck by the pair of platforms and thereby pivot the two pivotal latching means.

14. A training apparatus for skaters according to claim 6, wherein each one of the pair of platforms are provided with a projection which projections are aligned to strike the two pivotal latching means and there by pivot the two pivotal latching means.

15. A training apparatus for skaters according to claim 6, further comprising means to bias the two pivotal latching means.

16. A training apparatus for skaters according to claim 2, wherein the pair of track sections are pivotally coupled together.

17. A training apparatus according to claim 2, wherein the pair of track section are coupled together at approximately 90°.

18. A training apparatus for skaters according to claim 1, wherein each one of the pair of track sections includes a pair of elongate channel members.

19. A training apparatus for skaters according to claim 18, wherein each pair of elongate channel members are coupled together by at least one intermediate plate.

20. A training apparatus for skaters according to claim 19, wherein the pair of track sections are coupled together by end pieces which are provided at adjacent ends thereof.

* * * * *